US006672909B2

(12) United States Patent
Dewdney et al.

(10) Patent No.: US 6,672,909 B2
(45) Date of Patent: Jan. 6, 2004

(54) ELECTRICAL CONNECTION AND CONNECTORS

(75) Inventors: Guy James Ashley Dewdney, Slough (GB); Jonathan Michael White, Camberley (GB)

(73) Assignee: Icore International Limited, London (GB)

( * ) Notice: Subject to any disclaimer, the term of this patent is extended or adjusted under 35 U.S.C. 154(b) by 0 days.

(21) Appl. No.: 10/092,608

(22) Filed: Mar. 8, 2002

(65) Prior Publication Data

US 2002/0127922 A1 Sep. 12, 2002

(30) Foreign Application Priority Data

Mar. 8, 2001 (GB) ..... 0105656
Jul. 14, 2001 (GB) ..... 0117225

(51) Int. Cl.[7] ..... H01R 11/20
(52) U.S. Cl. ..... 439/787; 439/579; 439/98
(58) Field of Search ..... 439/579, 787, 439/98, 610, 464, 585, 608, 609, 447, 448, 463; 174/36, 29, 34, 78

(56) References Cited

U.S. PATENT DOCUMENTS 4,615,578 A 10/1986 Stadler et al.
4,830,628 A * 5/1989 Dyson et al. ..... 439/579
5,028,742 A * 7/1991 Redman ..... 174/78
5,414,211 A * 5/1995 Chan ..... 174/36
5,823,825 A * 10/1998 Murphy ..... 439/610
5,855,493 A 1/1999 Shelly
5,885,103 A * 3/1999 Ernolf et al. ..... 439/246
6,007,370 A * 12/1999 Langridge ..... 439/455
6,132,238 A * 10/2000 Hartmann et al. ..... 439/439
6,227,881 B1 * 5/2001 Tharp et al. ..... 174/29
6,264,476 B1 * 7/2001 Li et al. ..... 439/66
6,287,145 B1 9/2001 Goett

FOREIGN PATENT DOCUMENTS

GB 2 336 952 11/1999

* cited by examiner

*Primary Examiner*—P. Austin Bradley
*Assistant Examiner*—Edwin A. León
(74) *Attorney, Agent, or Firm*—Connolly Bove Lodge & Hutz LLP

(57) ABSTRACT

An electrical connector has a conductive member formed from several sheets of a resilient conductive material, such as a wire mesh or conductive textile. The sheets are layered and joined together at intervals to form separate passages between the sheets through the member. Screened wires in the connector pass through respective passages and the member is compressed about the wires by a strap tightened about the member so that electrical connection is made to the wire screens. The resilience of the member means that the strap can be released and retightened, allowing removal and replacement of wires.

14 Claims, 2 Drawing Sheets

ELECTRICAL CONNECTION AND CONNECTORS

BACKGROUND OF THE INVENTION

This invention relates to electrical connection and connectors.

The invention is more particularly concerned with connectors for making electrical connection to a screening sleeve of an electrical cable.

Where electrical connection is made to the screening sleeve of an electrical cable, it preferably has a low resistance and the connection is preferably of a kind that can be easily made and removed for servicing. If the screening sleeve is braided, it is preferable that the connection can be made without the need to separate the braid from the signal conductor.

In GB 2336952 there is described a connector for making connection to a conductive sleeve of a cable where the connector includes a wad of random electrically-conductive filamentary material encapsulated in an elastomeric material and having passages through which the wires extend so that electrical connection between the screening sleeves on the wires and the connector housing is made by the conductive filaments.

BRIEF SUMMARY OF THE INVENTION

It is an object of the present invention to provide an alternative connection to screening sleeves and the like.

According to one aspect of the present invention there is provided an electrical connection including a member formed substantially entirely of a conductive, resilient sheet material the member having a plurality of passages extending through the member between opposite ends, one for each of a plurality of wires, and means for radially inwardly compressing the member about the wires so that the member makes effective electrical connection with the outside of each wire when tightened and such that the member recovers substantially its original shape when the clamp is released.

The sheet material may be a wire mesh or of a conductive woven or knitted material. The sheet member may comprise a combination of metal fibres and non-metal fibres. The member may include two sheets of textile separated from one another by spacer fibres. The member may be of beryllium copper, copper or Monel. The means for compressing the member is preferably a clamp, such as including a strap embracing the member. The connection may include a disc located adjacent the member, the disc having an aperture for each wire. The member may include a sealing material, the sealing material being displaceable by insertion of wires in the member to enable electrical contact between the wires and the member. The sealing material may be a gel or a settable material.

According to another aspect of the present invention there is provided an electrical connection including a member formed substantially entirely of a conductive wire mesh material, the member having a plurality of passages extending through the member between opposite ends, one for each of a plurality of wires, and means for radially inwardly compressing the member about the wires so that the wire mesh makes effective electrical connection with the outside of each wire.

The wire mesh may be of beryllium copper, copper or Monel.

The sheet material may have a plurality of layers joined with one another at locations to form passages between the layers between the locations. Alternatively, the member may include a continuous strip of material folded backwards and forwards. Alternatively, the member may be of ladder shape rolled into a spiral.

An electrical connector according to the present invention will now be described, by way of example, with reference to the accompanying drawings.

DETAILED DESCRIPTION OF THE PREFERRED EMBODIMENTS

Figure 1:
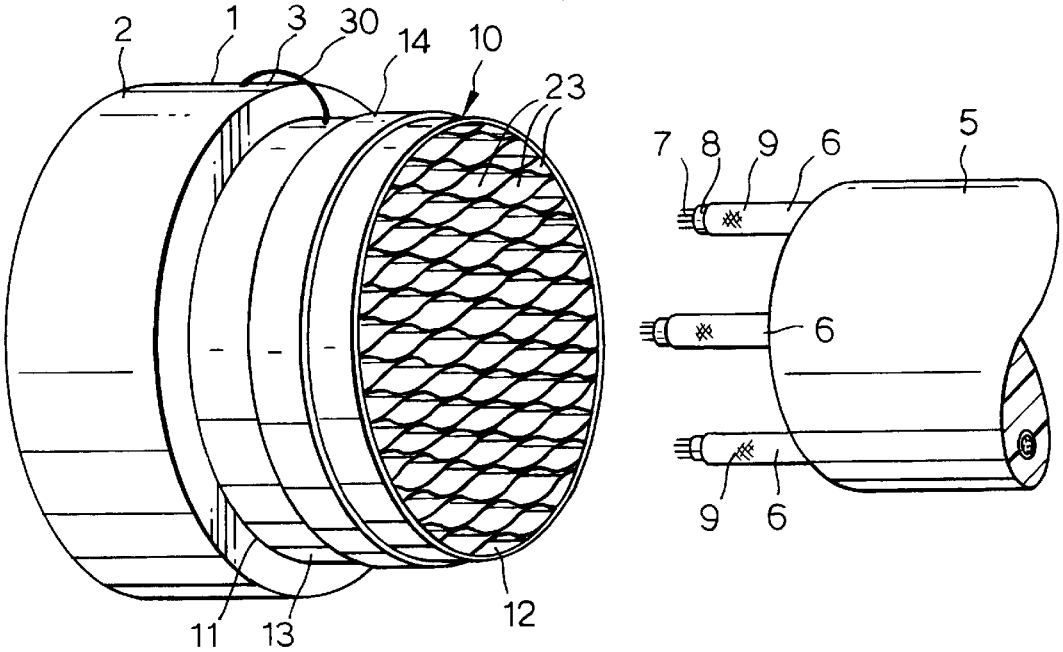
FIG. 1 is a perspective, exploded view of the connector.
Figure 2:
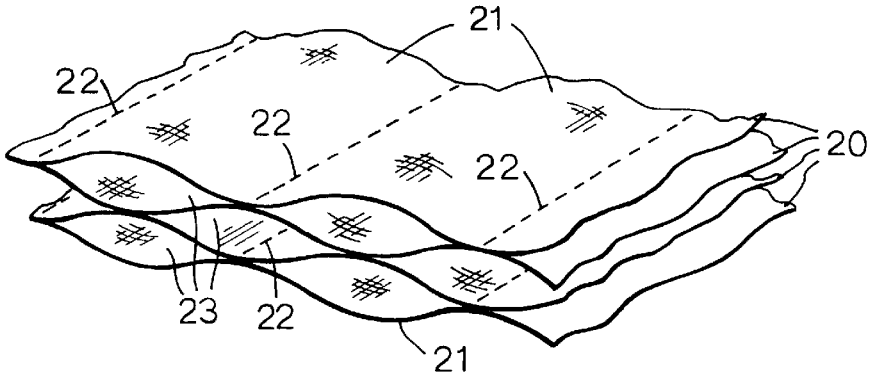
FIG. 2 is a perspective view of a part of the wire mesh member of the connector, illustrating its construction.

With reference first to FIGS. 1 and 2, the connector has a cylindrical outer metal shell 1 with a forward end 2 and a rear end 3. The forward end 2 of the connector contains an insulative insert supporting several pin or socket contact members (not shown) of conventional kind. An electrical cable 5 has several wires 6 within it each having a conductive core 7 encased within an insulative sheath 8, which in turn extends within a screening sleeve 9, such as of braided wire, providing a conductive outside surface to the wire. The cable enters the rear end 3 of the connector where the conductive cores 7 of each wire 6 are connected with respective ones of the contact members.

The connector also includes a grounding or earthing insert 10 of novel form. The insert 10 is of cylindrical shape and circular section with a forward end face 11 and a rear end face 12. The insert 10 comprises a central wire mesh member 13 and a clamp 14 embracing the mesh member. The mesh member 13 is made from several layers 20 of a loosely woven mesh of an electrically-conductive, springy wire such as beryllium copper, copper, Monel or similar material. Each layer 20 is in the form of a sheet or strip, crimped to form a series of laterally-extending corrugations 21. The layers 20 are stacked one on top of the other out of phase with one another such that the trough of one layer rests on the peak of the underlying layer. The layers are joined with one another along their lines of contact 22. This may be done by mechanical means, such as by stitching, stapling, clips or the like, or it may be done by bonding, such as with an electrically conductive adhesive, by welding, soldering or the like. In this way, parallel cells or passages 23 are formed between adjacent layers, between their lines of contact and retention. The cells between each pair of layers is out of phase with cells between an adjacent pair of layers. These passages 23 extend through the length of the mesh member 13 between opposite faces 11 and 12. The size of each passage 23 is such as to receive one of the wires 6 as a sliding fit.

The clamp 14 embraces the member 13 and is capable of applying a radially directed inward force about the mesh member to compress it firmly about the wires 6 and, more particularly, to compress it into effective electrical contact with the screening sleeve 9 on each wire. The clamp 14 may be of various different kinds. It could, for example, be of the kind having a looped strap the circumference of which is reduced by turning a screw at one end of the strap that engages a thread formation on the other end of the strap. Alternatively, the clamp could be in the form of a strap with teeth on its surface at one end and a ratchet at its other end so that the strap can be pulled tight and then retains the mesh member compressed.

The grounding insert 10 is electrically connected with the shell 1 of the connector. This may be achieved in various different ways. The insert 10 may be mechanically clamped into the shell by engagement with a backshell (not shown) screwed onto the shell. Alternatively, a wire 30 may extend between the shell 1 and the mesh member 13, or the clamp 14, where this is electrically conductive.

The arrangement of the present invention enables effective electrical connection to be made to multiple screened wires in a compact manner and without the need to separate the screens from the wires. A wire mesh can have a springy nature with a tendency to recover its original shape when the clamping force is removed. This makes it easy to remove and replace wires, thereby making the arrangement particularly suitable for applications where the connection needs to be serviceable. The resilient nature of wire mesh also helps ensure effective, long term connection with the screening sleeves because mesh can accommodate any deformation of the insulating sheath of the wires over time and maintain sufficient force urging the mesh into contact with the screens.

Figure 3:
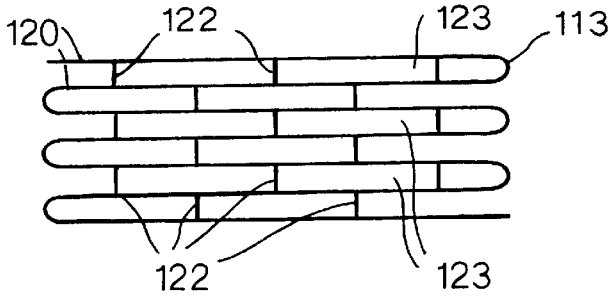
FIG. 3 shows schematically an alternative wire mesh member made from a single strip of wire mesh.

There are various other arrangements of conductive members, such as shown in FIG. 3. In this arrangement, the member 113 is in one continuous strip folded backwards and forwards to form a pleated stack. Adjoining layers 120 are attached with one another along several lines 122 extending parallel to the pleat folds, thereby separating the stack into multiple passages 123 along which the wires can be inserted.

Figure 4:
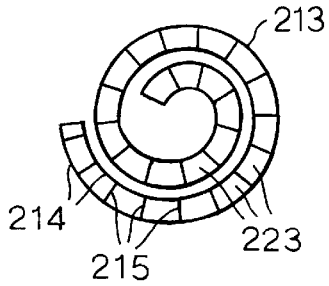
FIG. 4 shows another alternative wire mesh member formed in a spiral.

In the arrangement shown in FIG. 4, the conductive member 213 is of ladder shape comprising two parallel sides 214 and multiple lateral rungs 215. This is rolled into a spiral in the plane of the member so that the gaps between adjacent rungs 215 form passages 223 through the member 213.

Another form of member (not shown) could be provided by woven or knitted fibres. The fibres may be of a metal to make them conductive or may be of a non-conductive material coated with a conductive material, such as copper. The material could comprise a combination of metal fibres and of non-metal fibres to give the material desired mechanical properties, such as resilience. The construction of such a woven material could comprise two sheets of textile separated from one another by spacer fibres. Such a material, but of a nonconductive form, is available from Scott & Fyfe of Scotland.

Figure 5:
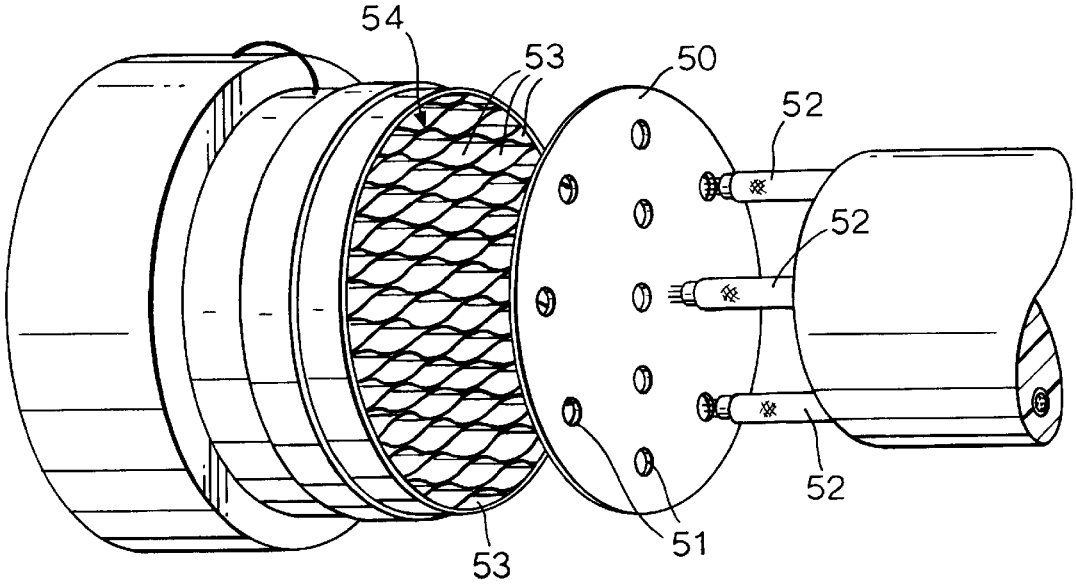
FIG. 5 is an exploded perspective view of a modified form of connector.

FIG. 5 shows a modification of the connector of FIG. 1 including a flexible disc 50 perforated with several holes 51, one for each of the wires 52, and aligned with passages 53 through the conductive member 54. The disc 50 is adjacent the member 54 and may (as shown) be a separate component attached or close to the member 54, or it may be an integral part of the member. The disc 50 serves to locate the wires 52 during insertion into the member 54. Preferably the disc 50 is electrically conductive but it could be insulative.

If it is necessary for the connection to the screened wires to provide a seal against passage of, for example, liquids or gases, a sealing material may be added to a wire mesh, the material being of the kind that is displaced by the wires to enable electrical contact of the screens with meshes. Gels are available that will serve this function and improve the sealing properties of a mesh when this is compacted down around the wires. Settable fluids may be used where a permanent connection is to be made.

What we claim is:

1. An electrical connection comprising: a member formed substantially entirely of a conductive, resilient sheet material, said member having a plurality of passages extending through said member between opposite ends, one for each of a plurality of wires; and a clamp for radially inwardly compressing said member about said wires such that said member makes effective electrical connection with an outside of each wire when said clamp is tightened and such that said member recovers substantially its original shape when said clamp is released.

2. A connection according to claim 1, wherein said sheet material is of a wire mesh.

3. A connection according to claim 1, herein said member is of a conductive woven or knitted material.

4. A connection according to claim 1, wherein said member comprises a combination of metal fibres and non-metal fibres.

5. A connection according to claim 1, wherein said member includes two sheets of textile separated from one another by spacer fibres.

6. A connection according to claim 1, wherein said member is of beryllium copper, copper or Monel.

7. A connection according to claim 1, wherein said clamp includes a strap embracing said member.

8. A connection according to claim 1 including a disc located adjacent said member, and wherein said disc has an aperture for each said wire.

9. A connection according to claim 1, wherein said sheet material has a plurality of layers joined with one another at locations to form passages between the layers between the locations.

10. A connection according to claim 1, wherein said member includes a continuous strip of material folded backwards and forwards.

11. A connection according to claim 1, wherein said member is of ladder shape rolled into a spiral.

12. A connection according to claim 1, wherein said member includes a sealing material, and wherein said sealing material is displaceable by insert on of wires in said member to enable electrical contact between the wires and said member.

13. A connection according to claim 9, wherein said sealing material is a gel.

14. A connection according to claim 9, wherein said sealing material is a settable material.

* * * * *